US011525624B2

(12) United States Patent
Ciniello et al.

(10) Patent No.: US 11,525,624 B2
(45) Date of Patent: Dec. 13, 2022

(54) REFRIGERATOR WITH MAGNETIC BIN SYSTEM

(71) Applicant: WHIRLPOOL CORPORATION, Benton Harbor, MI (US)

(72) Inventors: Pasquale Ciniello, Comerio (IT); Kamil El Sayed, Wroclaw (PL); Marek Gorzelanczyk, Bierzow (PL); Piotr Grzyb, Wroclaw (PL); Roberto Riccardi, Induno Olona (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/133,765

(22) Filed: Dec. 24, 2020

(65) Prior Publication Data

US 2021/0123666 A1 Apr. 29, 2021

Related U.S. Application Data

(63) Continuation of application No. 16/286,866, filed on Feb. 27, 2019, now Pat. No. 10,907,892.

(51) Int. Cl.
*F25D 25/02* (2006.01)
*F25D 23/02* (2006.01)

(52) U.S. Cl.
CPC ..... *F25D 25/02* (2013.01); *F25D 23/028* (2013.01); *F25D 2323/02* (2013.01); *F25D 2325/021* (2013.01)

(58) Field of Classification Search
CPC ..... F25D 23/02; F25D 23/028; F25D 25/02; F25D 25/022; F25D 2323/02; F25D 2325/021

(Continued)

(56) References Cited

U.S. PATENT DOCUMENTS 4,010,736 A * 3/1977 Sacomani ..... A47J 27/10 126/369
5,705,215 A * 1/1998 Riach, Jr. ..... A23L 3/26 426/524

(Continued)

FOREIGN PATENT DOCUMENTS

CN 1888768 A 1/2007
CN 206891003 U 1/2018

(Continued)

*Primary Examiner* — James O Hansen

(74) *Attorney, Agent, or Firm* — Price Heneveld LLP

(57) ABSTRACT

A refrigerator includes a housing defining an interior compartment with an open side and a door rotatably coupled with the housing. The door includes a liner defining an outer attachment surface and an opposite inner surface. The attachment surface includes a plurality of indicia corresponding with a plurality of predetermined attachment locations along the attachment surface. The door further includes a plurality of first magnetic components adjacent the interior surface and aligned with respective ones of the indicia. The refrigerator further includes a storage component defining a mounting surface having an area smaller than the attachment surface. The storage component includes a second magnetic component selectively releasably attachable to the liner at a selected one of the predetermined attachment locations by mutual attraction between the first magnetic component corresponding with the selected one of the predetermined attachment locations and the second magnetic component.

15 Claims, 7 Drawing Sheets

(58) Field of Classification Search
USPC ..... 312/401, 405, 405.1, 408, 321.5
See application file for complete search history.

(56) References Cited

U.S. PATENT DOCUMENTS

| | | | | |
|---|---|---|---|---|
| 5,810,462 | A | 9/1998 | Lee | |
| 7,188,738 | B2 | 3/2007 | Stafford et al. | |
| 7,309,116 | B2 | 12/2007 | Garrett et al. | |
| 8,726,689 | B2 | 5/2014 | Jang et al. | |
| 8,739,568 | B2 | 6/2014 | Allard et al. | |
| 9,500,403 | B2 | 11/2016 | Seo et al. | |
| 2003/0151339 | A1* | 8/2003 | Reed | E05D 7/081 312/405 |
| 2012/0018434 | A1 | 1/2012 | Gwak | |
| 2013/0104590 | A1 | 5/2013 | Seo et al. | |
| 2016/0003520 | A1 | 1/2016 | Wang et al. | |
| 2016/0057394 | A1 | 2/2016 | Marutani et al. | |
| 2016/0123655 | A1 | 5/2016 | Chow et al. | |
| 2020/0271379 | A1 | 8/2020 | Ciniello et al. | |

FOREIGN PATENT DOCUMENTS

| | | | |
|---|---|---|---|
| CN | 206891020 | U | 1/2018 |
| CN | 108613468 | A | 10/2018 |
| DE | 8517976 | U1 | 9/1985 |
| DE | 29605880 | U1 | 6/1996 |
| DE | 102012223543 | A1 | 6/2014 |
| EP | 2587199 | A2 | 5/2013 |
| KR | 20060022100 | A | 3/2006 |
| KR | 20070062843 | A | 6/2007 |
| KR | 20130045593 | A | 5/2013 |
| KR | 20160034044 | A | 3/2016 |
| WO | 2018103948 | A1 | 6/2018 |

* cited by examiner

REFRIGERATOR WITH MAGNETIC BIN SYSTEM

CROSS-REFERENCE TO RELATED APPLICATION

This application is a continuation of U.S. patent application Ser. No. 16/286,866, now U.S. Pat. No. 10,907,892, filed Feb. 27, 2019, and entitled "REFRIGERATOR WITH MAGNETIC BIN SYSTEM." The entire disclosure of which is incorporated herein by reference in its entirety.

BACKGROUND

The present device generally relates to a reconfigurable storage arrangement for a refrigerator, and more specifically, to a refrigerator with bins attaching to an interior of a refrigerator door using magnetic attraction.

Most types and configurations of refrigerators provide for some type of storage of items along an interior portion or surface of the door or doors used to enclose one or both of the fresh food and freezer compartments provided therein. In connection with larger refrigerators, a number of door bins or other compartments are often removably coupleable with the interior of the door by way of interengaging features of the door and the various components. Such arrangements require that the bins or compartments be of a generally uniform size and be positioned in various predetermined locations. Accordingly, only limited adjustability or reconfiguration of the storage provided along the door is provided. In this manner, further advancements may be desired.

SUMMARY

In at least one aspect, a refrigerator includes a housing defining an interior compartment with an open side and a door rotatably coupled with the housing and selectively closing at least a portion of the open side. The door includes an interior liner defining an attachment surface and at least one first magnetic component adjacent the attachment surface. The refrigerator further includes a storage component defining a mounting surface having an area smaller than the attachment surface. The storage component includes a second magnetic component adjacent the mounting surface and removably retaining the mounting surface of the storage component to the attachment surface of the door by mutual attraction between the at least one first magnetic component and the second magnetic component.

In at least another aspect, a refrigerator includes a housing defining an interior compartment with an open side and a door rotatably coupled with the housing and selectively closing at least a portion of the open side. The door includes an interior liner defining an attachment surface and a plurality of first magnetic components adjacent the attachment surface and distributed along an area of the attachment surface. The refrigerator further includes a storage component defining a mounting surface having an area smaller than the attachment surface. The storage component includes a second magnetic component adjacent the mounting surface and removably retaining the mounting surface of the storage component to the attachment surface of the door by mutual attraction between one of the first magnetic component and the second magnetic component.

In at least another aspect, a refrigerator includes a housing defining an interior compartment with an open side and a door rotatably coupled with the housing and selectively closing at least a portion of the open side. The door includes an interior liner defining an attachment surface and a first magnetic component adjacent an extending along an entirety of the attachment surface. The refrigerator further includes a storage component defining a mounting surface having an area smaller than the attachment surface. The storage component includes a second magnetic component adjacent the mounting surface and removably retaining the mounting surface of the storage component to the attachment surface of the door by mutual attraction between the first magnetic component and the second magnetic component.

In at least another aspect, a refrigerator includes a housing defining an interior compartment with an open side and a door rotatably coupled with the housing and selectively closing at least a portion of the open side. The door includes a liner defining an outer attachment surface and an opposite inner surface. The attachment surface includes a plurality of indicia corresponding with a plurality of predetermined attachment locations along the attachment surface. The door further includes a plurality of first magnetic components adjacent the interior surface and aligned with respective ones of the indicia. The refrigerator further includes a storage component defining a mounting surface having an area smaller than the attachment surface. The storage component includes a second magnetic component selectively releasably attachable to the liner at a selected one of the predetermined attachment locations by mutual attraction between the first magnetic component corresponding with the selected one of the predetermined attachment locations and the second magnetic component.

In at least another aspect, a refrigerator door assembly includes a liner defining an outer attachment surface and an opposite inner surface. The attachment surface includes a plurality of indicia corresponding with a plurality of predetermined attachment locations along the attachment surface. The door further includes a plurality of first magnetic components adjacent the interior surface and aligned with respective ones of the indicia. The assembly further includes a storage component defining a mounting surface having an area smaller than the attachment surface. The storage component includes a second magnetic component selectively releasably attachable to the liner at a selected one of the predetermined attachment locations by mutual attraction between the first magnetic component corresponding with the selected one of the predetermined attachment locations and the second magnetic component In at least another aspect, a refrigerator includes a housing defining an interior compartment with an open side and a door rotatably coupled with the housing and selectively closing at least a portion of the open side. The door includes a liner defining an outer attachment surface and an opposite inner surface. The attachment surface includes a plurality of raised areas corresponding with a plurality of predetermined attachment locations along the attachment surface. The door further includes a plurality of first magnetic components adjacent the interior surface and aligned with respective ones of the raised areas. The refrigerator further includes a storage component defining a mounting surface having an area smaller than the attachment surface. The storage component includes a second magnetic component selectively releasably attachable to the liner at a selected one of the predetermined attachment locations by mutual attraction between the first magnetic component corresponding with the selected one of the predetermined attachment locations and the second magnetic component.

These and other features, advantages, and objects of the present device will be further understood and appreciated by those skilled in the art upon studying the following specification, claims, and appended drawings.

DETAILED DESCRIPTION OF EMBODIMENTS

Figure 1:
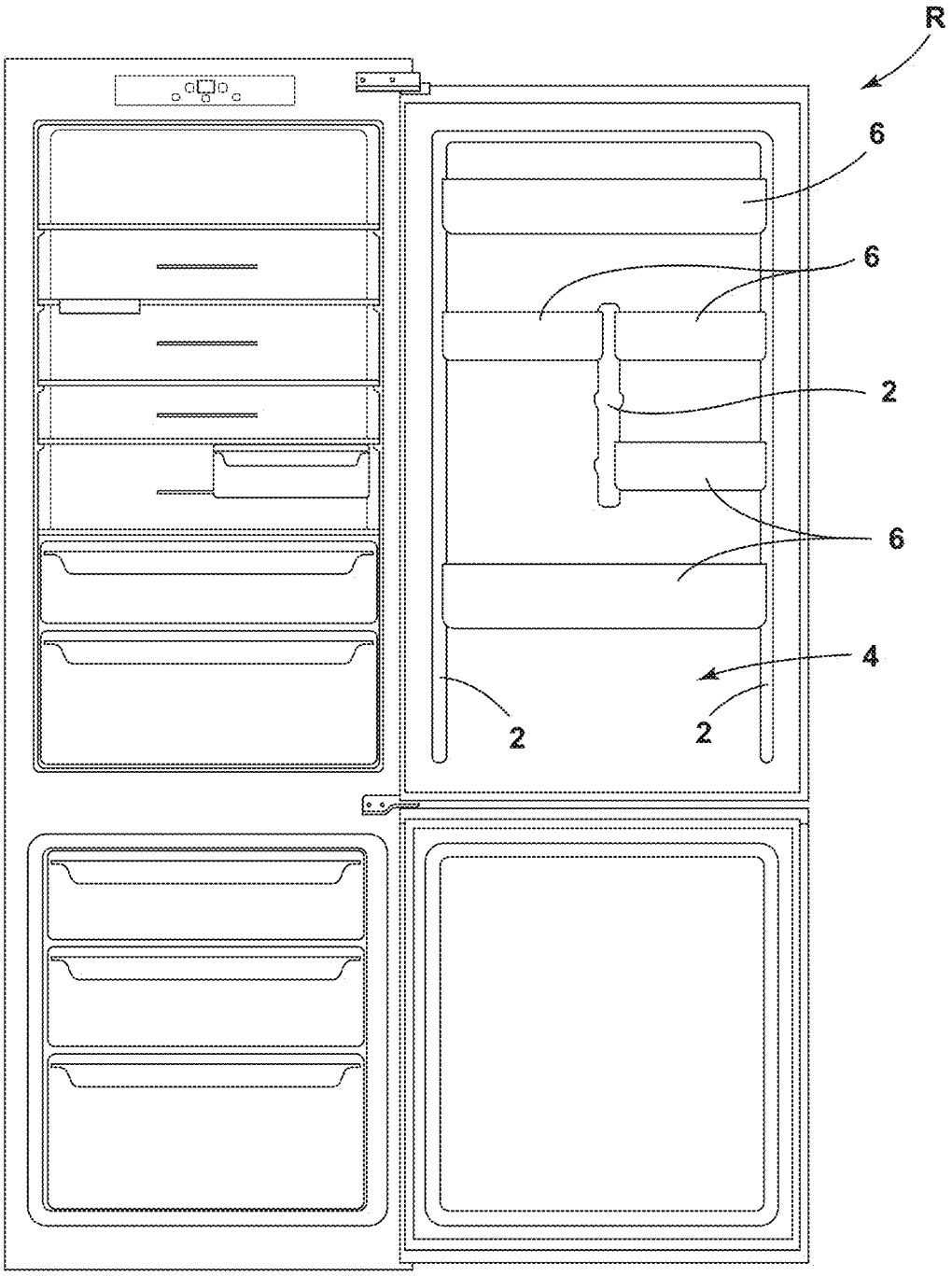
FIG. 1 (related art)
FIG. 1 is a front perspective view of a related art refrigerator including a known arrangement for adjustably retaining various storage components with the door thereof.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIGS. 2-8, reference numeral 10 generally designates a refrigerator. The refrigerator 10 includes a housing 12 that in the present example includes an outer wrapper 14 and an interior liner 16 with an insulating material filling a void between the wrapper 14 and the liner 16. The housing 12 defines an interior compartment 18 bounded on five sides by the interior of the liner 16 with an open side 20 allowing for access to the interior compartment 18. A door 22 is rotatably coupled with the housing 12 and selectively closes at least a portion of the open side 20 of the interior compartment 18. The door 22 includes a door liner 24 within a door wrapper 26 that, similar to housing 12, encloses insulation within a void between the door liner 24 and the door wrapper 26. In this respect, the depicted refrigerator 10 is generally similar to the related refrigerator R shown in FIG. 1.

The present refrigerator 10 is adapted for selective configuration and increased adaptability compared to the related refrigerator R by the door liner 16 being configured to define an attachment surface 28 thereon that notably lacks the mounting ridges 2 included in the door 4 of the related refrigerator R that are used to retain the various bins 6. In this manner, the present refrigerator 10 includes, within door 22 at least one first magnetic component 30 adjacent the attachment surface 28. The refrigerator 10 further includes a storage component 32 defining a mounting surface 34 having an area smaller than the attachment surface 28. The storage component 32 includes a second magnetic component 36 adjacent the mounting surface 34 and removably retaining the mounting surface 34 of the storage component 32 to the attachment surface 28 of the door 22 by mutual attraction between the at least one first magnetic component 30 and the second magnetic component 36. As used herein, that the term "magnetic" does not require that the particular component be itself a magnet by way of producing its own persistent magnetic field. As would be understood one of the first and second magnetic components 30 and 36 can be a magnet (either a permanent magnet or an electromagnet, according to various examples herein) with the other of the magnetic components 30 or 36 being of a material (e.g., a ferromagnetic material) that produces a magnetic field in response to an applied magnetic field, such as that of a magnet, so that the mutual attraction between components is achieved. In some examples, both magnetic components 30 and 36 may be magnets, including in various combinations of permanent magnets and electromagnets. By this configuration, the storage component 32 can be retained with door 22 without assembly with the ridges 2 in the related refrigerator R, which, as discussed herein, can allow for greater flexibility with respect to the size and configuration of storage component 32, as well as the possible locations along door 22 with which the storage component 32 can be retained.

Figure 3:
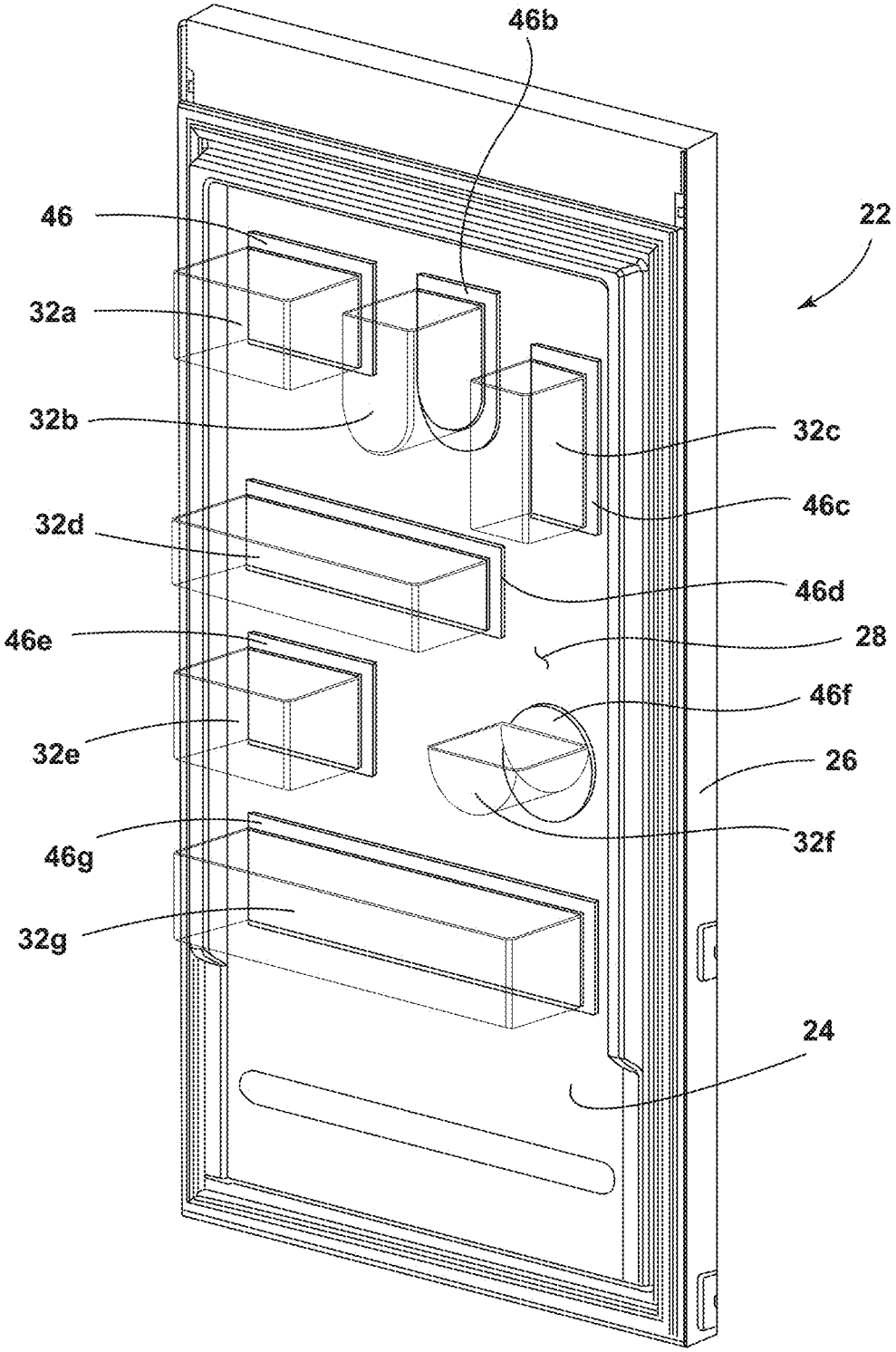
FIG. 3 is a perspective view of one arrangement of storage components removably retained with a door of the refrigerator.

As shown in FIG. 3, the storage component 32 can be a first storage component 32*a* of a plurality of storage components 32*a*-32*g* included in the illustrated example of refrigerator 10 (although more or fewer storage components 32 can be included). In the present example, each of the plurality of storage components 32*a*-32*g* can be similarly configured to achieve attachment and retention with door 22 in a similar manner and can, accordingly, each include respective second magnetic components 36 adjacent the respective mounting surfaces 34 such that the second magnetic components 36 removably retain the mounting surface 34 of the respective storage component 32*a*-32*g* to the attachment surface 28 of the door 22 by mutual attraction between the at least one first magnetic component 30 and the respective second magnetic component 36.

In one example, the storage component 32 can be a storage bin, as shown in the example of storage component 32*a*. In this manner, the storage component 32*a* can include a lower surface 38 for supporting articles thereon, such as containers, bottles, or the like. At least four side walls 40*a*-40*d* extend from the lower surface 38 and define an interior space 42 and an open top side 44 In such an arrangement, the mounting surface 34 is defined on one of the at least four side walls 40*a*-40*d* and, more particularly, along what is understandable as being configured as an outer wall 40*d* that is generally flat and extends along a width of the storage component 32 such that it is positionable flush against the generally flat attachment surface 28 of door 22. The illustrated arrangement of storage component 32*a* in the form of a bin can allow for easy placement of articles onto lower surface 38 through the open top 42 while providing the side walls 40*b*,40*c* and inner wall 40*a* to prevent the articles from falling off of lower surface 38, including during opening and closing of door 22. Other configurations for storage component 32 are possible, including the various other bin configurations of storage components 32*d*-32*e* and 32*g*, as well as the rounded bins of storage components 32*b* and 32*f*. Even further, storage components 32 can be configured as closeable compartments (such as those typically intended for the storage of butter, other dairy products or the like while maintaining a similar configuration for the mounting surface 34 along a comparable outer wall thereof. Other types of storage features or compartments found or used on refrigerator doors can be adapted to storage compartments 32 including a mounting surface 34 and a second magnetic component 36 to removably attach the storage components to the attachment surface 28 of door 22 according to the general principles discussed herein.

Figure 4:
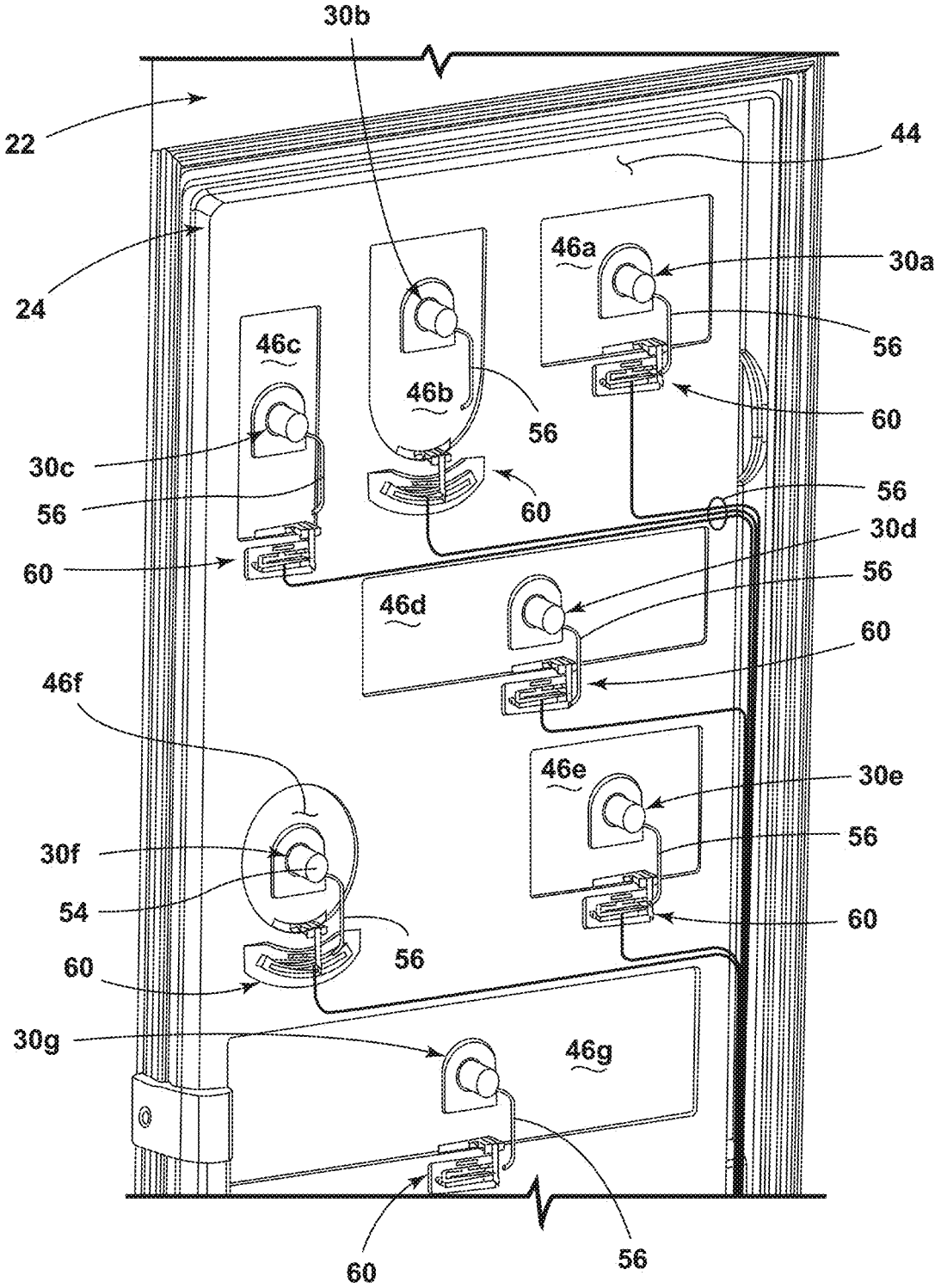
FIG. 4 is a perspective view of an interior of the door showing various magnetic components of the door.
Figure 5:
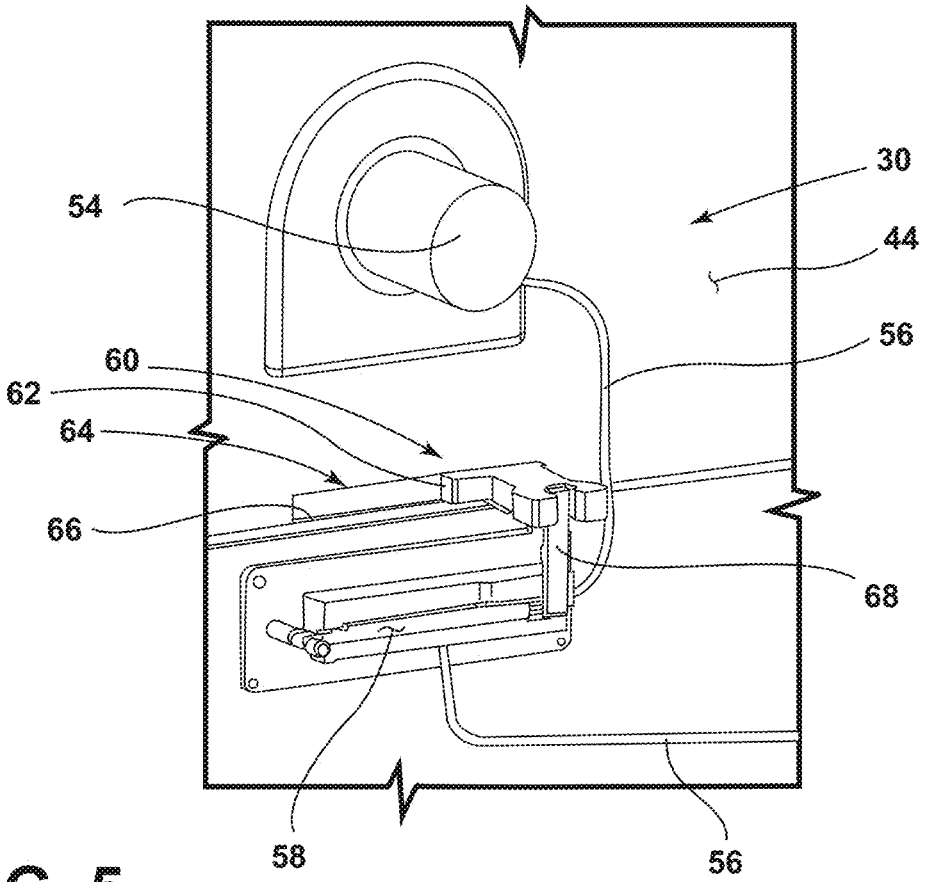
FIG. 5 is a detail view of one example of a magnetic component of the door.

As shown in FIGS. 4 and 5, the door 22 includes a plurality of first magnetic components 30*a*-30*g* that are positioned adjacent the attachment surface 28, including by being positioned within the void between the door liner 24 and the door wrapper 26 on what would be considered an "outer" surface 44 of the door liner 24 opposite the attachment surface 28, which is enclosed within the interior compartment 18 when door 22 is in the closed position. Further, the various first magnetic components 30*a*-30*g* are distributed along the area of the attachment surface 28 so as to be generally spaced apart from each other and to cover a portion of the door liner 24 over which it may be desirable to removably affix various storage components 32, such as storage components 32*a*-32*g* shown in FIG. 3. In this manner, the various storage components 32*a*-32*g* are selectively removably retainable at their respective mounting surfaces 34 at a plurality of locations 46*a*-46*g* along the attachment surface 28 of the door 22 by mutual attraction between selected ones of the plurality of first magnetic components 32*a*-32*g* and the second magnetic components 36 of the respective storage components 32*a*-32*g*. As shown in FIGS. 3 and 4, the attachment locations 46*a*-46*g* can be defined as raised portions of the attachment surface 24, with corresponding indentions along the opposite surface in which the first magnetic components 32*a*-32*g* are present. As further shown, the outer edges of the raised attachment areas 46*a*-46*g* can generally correspond with the shape of one or more of the types of storage components 32*a*-32*g* that is intended to be attached thereto such that indicia of the corresponding attachment areas 46*a*-46*g* are realized.

More particularly, the various plurality of locations 46*a*-46*g* can correspond with the positioning of the plurality of first magnetic components 30*a*-30*g* and can be positioned and arranged such that the plurality of storage components 32*a*-32*g* can be selectively attached with door 22 among the various locations 46*a*-46*g* in various configurations. In various examples, these configurations can include fewer storage components 32 than what is depicted in FIGS. 3 and 4 by removal of one or more of the depicted storage components 32*a*-32*g* or repositioning of the included ones of the storage components 32 in different locations 46*a*-46*g* than what is depicted in FIG. 3. In another example, various ones of the illustrated components 32*a*-32*g* can be swapped out for different components, such as enclosable compartments or the like. Still further, more locations 46 can be included by the assembly of additional first magnetic components 30 than what is shown, including more locations 46 than can reasonably accommodate attachment of storage components 32 therein to provide increased flexibility of arrangements in which the included storage components 32 can be assembled. In this manner a system of storage components 32 for use in connection with door 22 can be provided in connection with or in addition to refrigerator 10 to allow the user to implement various configurations of mix-and-match storage components, as desired to accommodate the articles intended to be stored on the door 22 of refrigerator 10. Similarly, refrigerator 10 can include an additional compartment 48 such that the interior compartment 18 discussed above is a designated fresh food compartment and the additional compartment 48 is a freezer compartment. In this manner, door 22 could include an additional attachment surface with further first magnetic components 30 to provide additional locations 46 associated with the additional compartment 48. The respective attachment locations 46*a*-46*g* can include an indication of various sizes and types of storage components 32 that can be or are otherwise intended to be attached therewith, including by embossing or debossing of the door liner 24 or by way of a printed indication or the like. In a variation, the locations 46 can be marked only in the location of the respective first magnetic component 30, without an indication of a specific storage component configuration.

Variations of refrigerator 10 can include an additional door dedicated for use with the additional compartment 48. In a further variation, the refrigerator can be a side-by-side arrangement with two adjacent doors, including door 22 for enclosing horizontally-positioned fresh food 18 and freezer 48 compartments, with each door including an attachment surface 28 with respective first magnetic components 30 therealong for retaining various storage components thereon. Still further, a variation of refrigerator 10 can include a French door arrangement wherein two doors 22 cooperatively close the fresh food compartment 18 with each door 22 including a respective attachment surface 28 with respective first magnetic components 30 therealong for retaining various storage components thereon.

Continuing with respect to FIGS. 4-7, the first magnetic component 30 or components 30*a*-30*g*, for example, include permanent electromagnets 54 that exhibiting a magnetic field having a maximum strength in the absence of an electrical current and are configured such that the strength of the associated magnetic field diminishes in the presence of an electrical current. In this respect, the strength of the magnetic field of the first magnetic component 30 can be variably reduced below the maximum by a variable increase in electrical current applied to the permanent electromagnet 54. As shown, refrigerator 10 can be adapted to provide and utilized the ability to control the magnetic field of permanent electromagnet 54. In particular, circuitry 56 can be included within door 22 to carry an electric current to the permanent electromagnets 54 for each of the first magnetic components 30 included in door 22. In this manner, the electronic circuitry 56 can include or otherwise connect with a wire coil or the like that can surround the permanent electromagnet as part of the first magnetic components 30 such that the electronic circuitry can expose the permanent electromagnet 54 to an electrical current to achieve the described diminished strength of the permanent electromagnet 54. In this respect, it is noted that various arrangements of electronic circuitry can be used to expose the permanent electromagnet 54 to varying levels of electrical current. As mentioned, bare copper wire or the like can be wrapped directly around the permanent electromagnet 54 in varying densities with electrical power being supplied to the wire coil to cause electrical current to surround the permanent electromagnet 54 for exposure to the resulting electromagnetic field, which can effectively alter the overall strength of the resulting first magnetic component 30. Other arrangements are possible, including placing a coiled disk of wire adjacent to a disk-shaped (rather than cylindrically shaped) permanent electromagnet 54. Further, the electronic circuitry need not be a wire and need not be bare or in direct contact with the permanent electromagnet 54. In one aspect, a printed flex circuit can be positioned around or adjacent the permanent electromagnet 54 (including over an additional insulating layer) and connected with the additional electronic circuitry 56 to expose the permanent electromagnet 54 to the desired current. In this respect, the electronic circuitry 56 can be "operably adjacent" to permanent electromagnet 54 to the extent that the available current provided by the electronic circuitry has the desired effect on the associated permanent electromagnet 54, as described further herein.

The use of the above-described permanent electromagnet 54 and associated electronic circuitry 56 can be used to provide a mutual attraction between the first magnetic components 30 and associated second magnetic components 36 to retain the storage components 32 with the attachment surface 28 of door 22 with a force sufficient to maintain the storage components 32 in the desired respective locations, including when storage components 32 are used to store and retain articles. In this manner, the force desired for the various first magnetic components 30 can depend on the size of the storage components 32 to be used with refrigerator 10 (including, for example, the largest of such storage components 32 that can be used in the respective location 46) and the goods expected to be stored therein, such as canned goods, packaged beverages, dairy products or the like. In various examples, the maximum retention force of the first magnetic components 30 is dictated by the strength of the respective permanent electromagnets 54 when unexposed to current and can range, for example from about 30 N to 50 N or greater.

It can be appreciated that the use of stronger permanent electromagnets 54 to retain heavier articles in greater quantities, for example, can result in storage components 32 being difficult to detach from door 22 for removal or repositioning thereof. In this manner, the use of permanent electromagnets 54 in the first magnetic components 30 allows for the retention force to be diminished in a selective manner by the exposure of permanent electromagnets 54 to a current using electronic circuitry 56. It is noted that such an arrangement may be preferred to those using a standard electromagnet (wherein the magnetic force is achieved by the use of a current) because no current is needed to retain storage components 32 in place, which is the most frequent state of use, with a current only needed when detachment of the storage components 32 is desired. In this manner, a potentiometer 58 can be included in or can be otherwise connected with electronic circuitry 56 to allow the electrical current to which the permanent electromagnet 54 is exposed to be adjusted from zero (or another minimum value acceptably close to zero) to a maximum level sufficient to change the strength of the permanent electromagnet 54 to the diminished level that can be determined as sufficient for removal of the storage components 32. In one example, the diminished level can vary in the particular value from the maximum strength of permanent electromagnet 54 with the level of the current provided, which can be smoothly varied by potentiometer 58. Further the diminished level may not extend completely to zero so that storage components 32 do not fall from door 22 when the strength of permanent electromagnet 54 is diminished to the full extent provided by the related system but rather remains at a strength where the storage components 32 can be removed from door 22, e.g. between 1 N and 5 N of retention force.

To allow the user to selectively control the release of a particular storage components 32*a*-32*g* from a particular location 46*a*-46*g* along attachment surface 28 a control element 60 can be associated with the first magnetic components 30*a*-30*g*. As shown in FIGS. 4 and 5, first magnetic components 30 can be mounted with the door liner 24 at the outer surface 44 thereof so as to be generally obscured from view. In this manner, the first magnetic components 30 can be directly coupled with the door liner 24, including by way of adhesives and/or mechanical fasteners, such as screws or the like, or can be assembled with a supporting frame that is affixed within door 22 adjacent the outer surface 44 of door liner 24. In this manner, the control element 60 can include a slider 62 mounted on a track 64 adjacent to or included within the first magnetic components 30 structure. The slider 62 can extend through a slot 66 in door liner 24 (that in an example can define the track 64) such that slider is positioned along the attachment surface 28 and accessible to the user. The slider 62 can be mechanically coupled with a link element 68 so that movement of slider 62 along track 64 adjusts the position of the potentiometer 58 input, which adjusts the current provided to the associated permanent electromagnet 54. This arrangement allows the user to control the strength of the permanent electromagnet 54 downward, as needed to remove the associated storage component without the storage component 32 becoming suddenly or unexpectedly dislodged from door 22. In this manner, the storage component 32 remains in a retained stated with the door 22 under a predetermined load (e.g., up to 5 kg at a retention force of about 30 N to 50 N) under the maximum strength of the magnetic field of permanent electromagnet 54. Similarly, the storage component 32 is removable from the door 22 by a force over a predetermined threshold (e.g. 10 N) under the diminished strength of the magnetic field of permanent electromagnet 54. As can be appreciated he predetermined load capacity of storage component 32 is greater than the predetermined threshold for removal.

Figure 6:
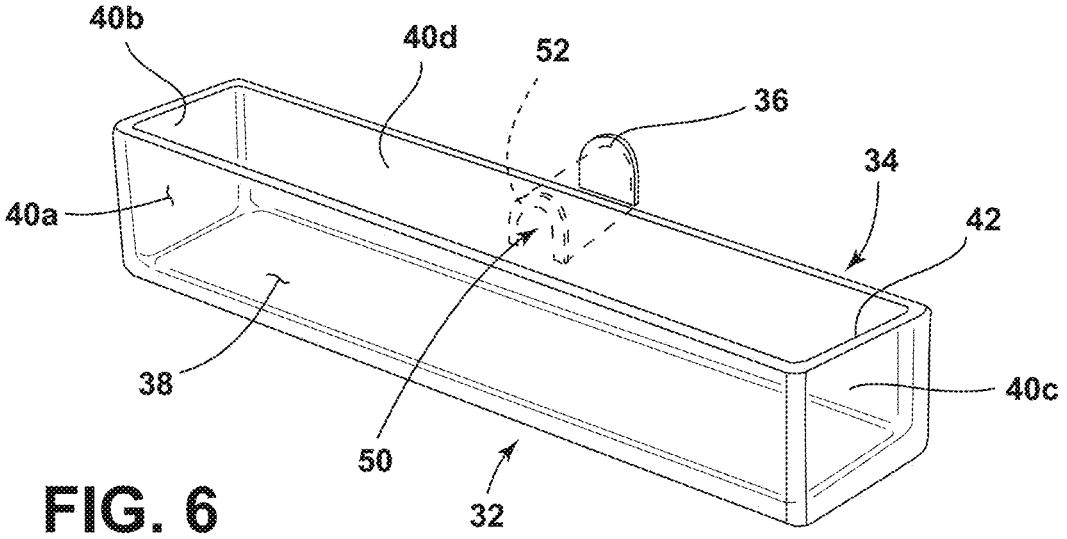
FIG. 6 is an assembly view of an example of a storage component with a magnetic component thereof.
Figure 7:
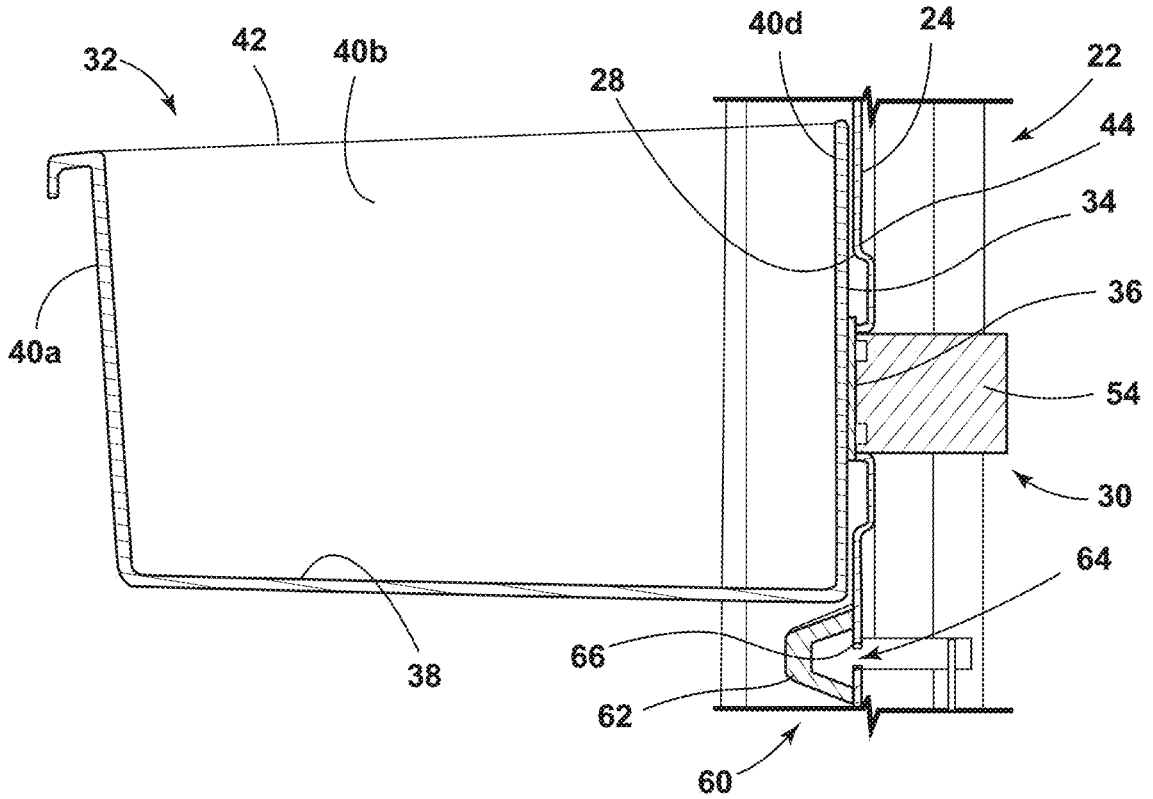
FIG. 7 is a cross-section view of the example storage component attached with the door by mutual attraction between the magnetic components.

As shown in FIGS. 6 and 7, the second magnetic component 36 associated with each of the various storage components 32 can be a piece or section of a ferromagnetic or magnetic substrate that can be coupled to the outer wall 40*d* of the storage component 36 over or otherwise adjacent the mounting surface 34. In one example, the second magnetic component 36 can be a piece of steel or other ferrous metal such that it is magnetically attracted to the permanent electromagnets 54 associated with the various first magnetic components 30. In another example, the second magnetic component 36 can be a magnet for additional mutual attraction with the respective permanent electromagnet 54, with the magnetic field of such second magnetic component 36 being low enough to allow release of the associated storage component 32, as discussed above. As shown in FIG. 6, the attraction between the first and second magnetic components 30 and 36 can be such that storage component 32 can be retained with door 22 with the corresponding portion of door liner 24 positioned therebetween. In this manner, the first and second magnetic components 30,36 can be positioned operably adjacent each other such that the mutual attraction therebetween retains the storage component 32 with door 22, without actual contact between the first and second magnetic components 30,36. As shown in FIG. 6, the second magnetic component 36 can be received in a pocket 50 defined by a flange 52 or the like extending from or recessed within mounting surface 34 to provide the desired placement and retention of the second magnetic component 36 with the storage component 32.

Figure 8:
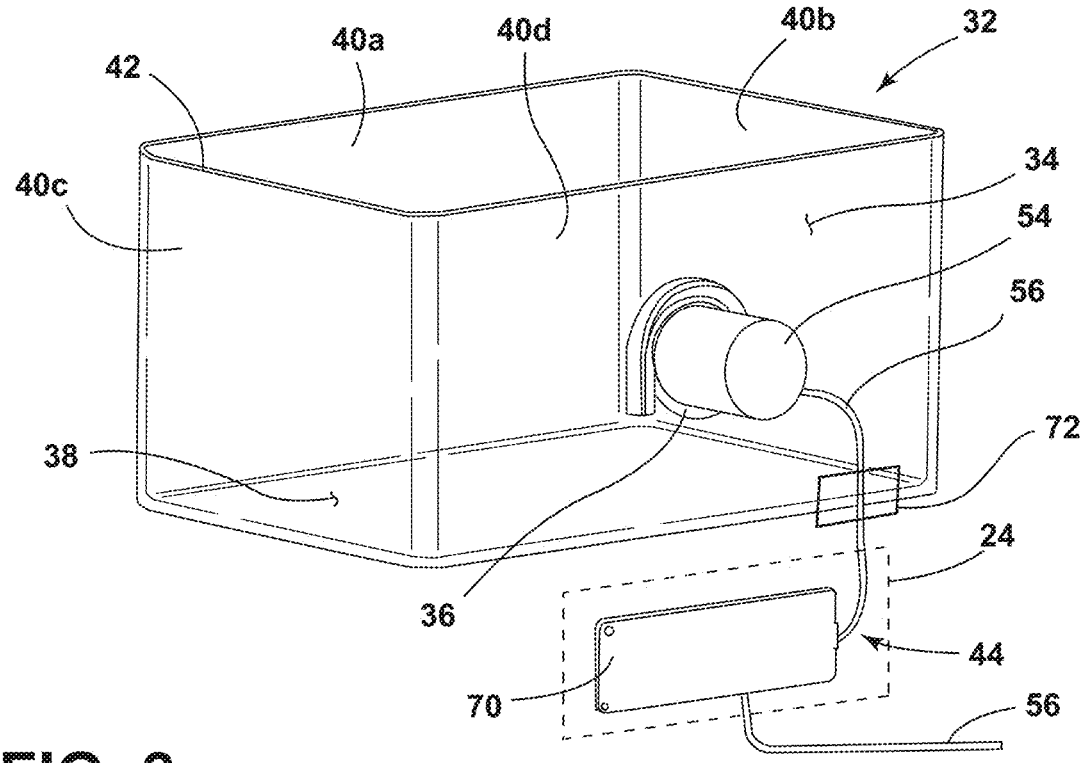
FIG. 8 is a perspective view of an alternative magnetic component associated with a storage component.

In an alternative arrangement shown in FIG. 8, an electronic touch circuit (such as a touch sensitive element 70, including a capacitive touch element or the like) can replace the slider 62 as the control element 60. In this example, the touch sensitive element 70 can be mounted with the outer surface 44 of door liner 24 so as to be obscured from view (with an appropriate graphical indication of the touch-sensitive area along attachment surface 28) and electrically connected with appropriate control circuitry 72 to control or replace the potentiometer 58 discussed above. In either arrangement, the electronic circuitry 56 within door 22 can connect with the overall power supply of refrigerator 10 to provide the voltage and current needed to expose the permanent electromagnet 54 to a current sufficient to achieve the desired minimum magnetic field strength therefor. In one example, refrigerator 10 can divide the power provided thereto (e.g., a 110 V 15 Amp electrical connection) between the power supplied to the cooling system and the power provided to the electronic controls for refrigerator 10, which can be reduced to, for example 12 V and between 1.5 and 5 Amp. In this manner, the potentiometer 58 (or other circuitry) can adjust the flow of current to which the associated permanent electromagnet 54 from zero to the maximum level of the associated system (e.g., 1.5 Amp) with the circuitry configured to expose the permanent electromagnet 54 to the desired electromagnetic field, given the characteristics of the associated electrical system.

Figure 2:
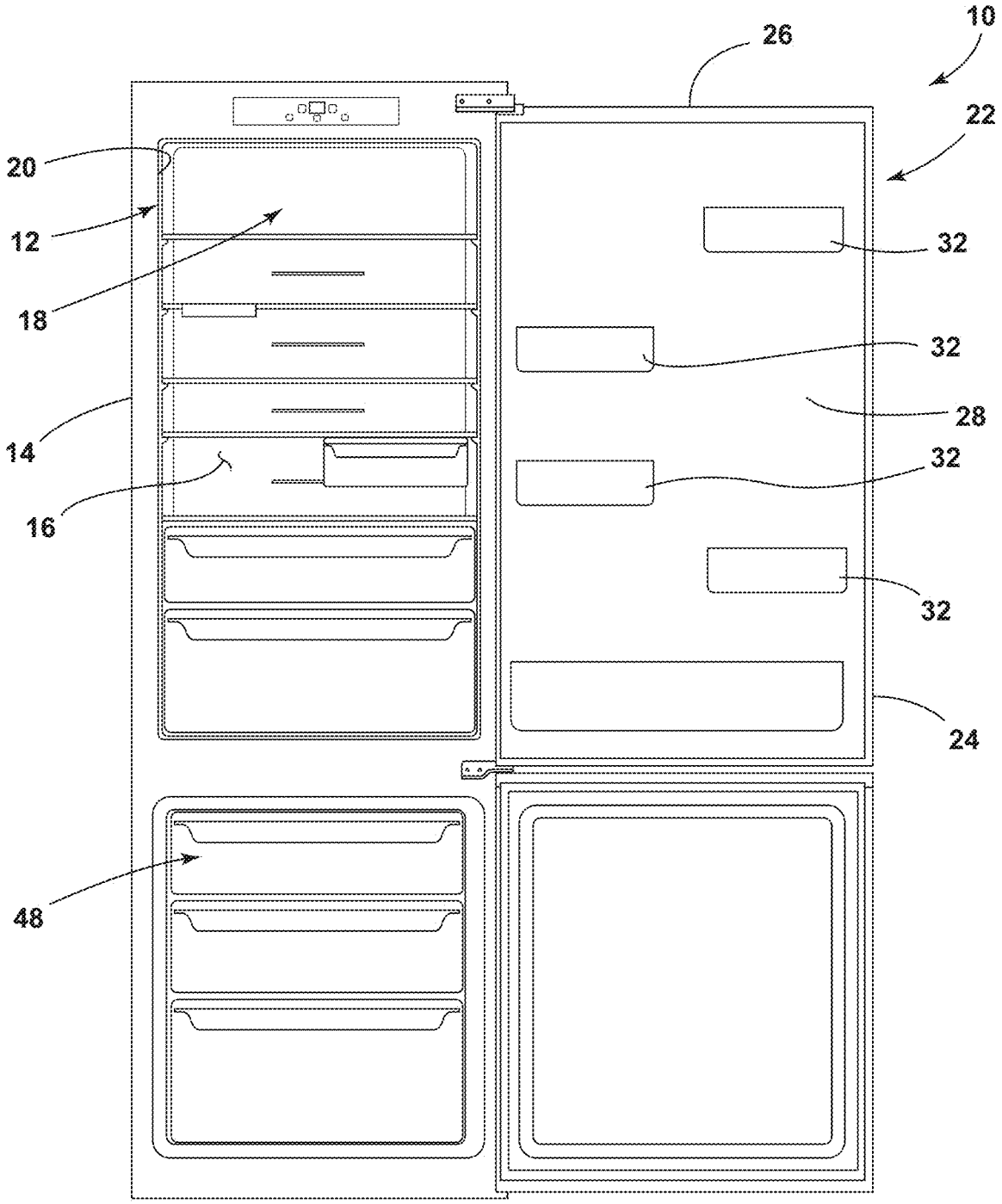
FIG. 2 is a front perspective view of a refrigerator according to the present disclosure with a magnetic arrangement to retain storage components with an attachment area of a door thereof.
Figure 9:
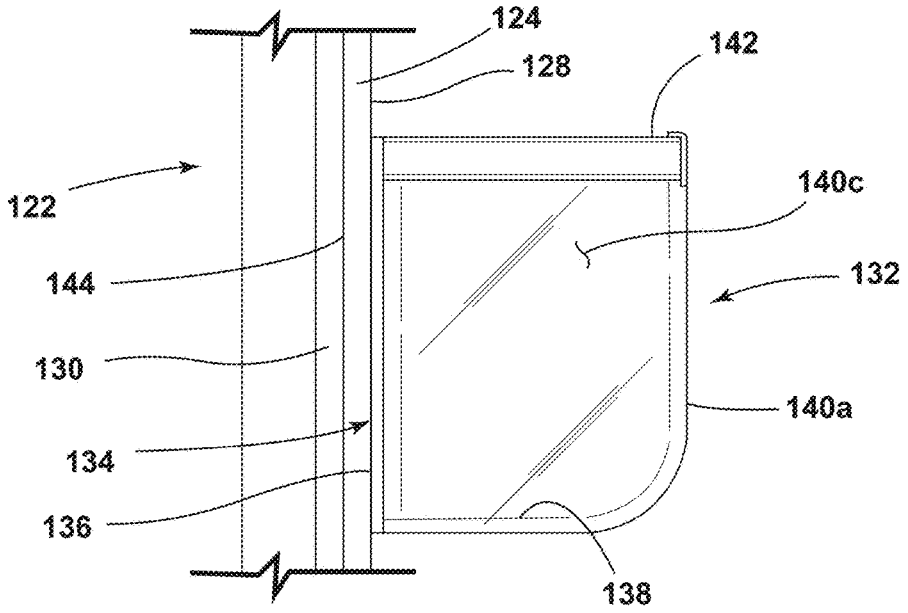
FIG. 9 is a side, partial cross-section view of an alternative magnetic arrangement to retain storage components with an attachment area of a refrigerator door.
Figure 10:
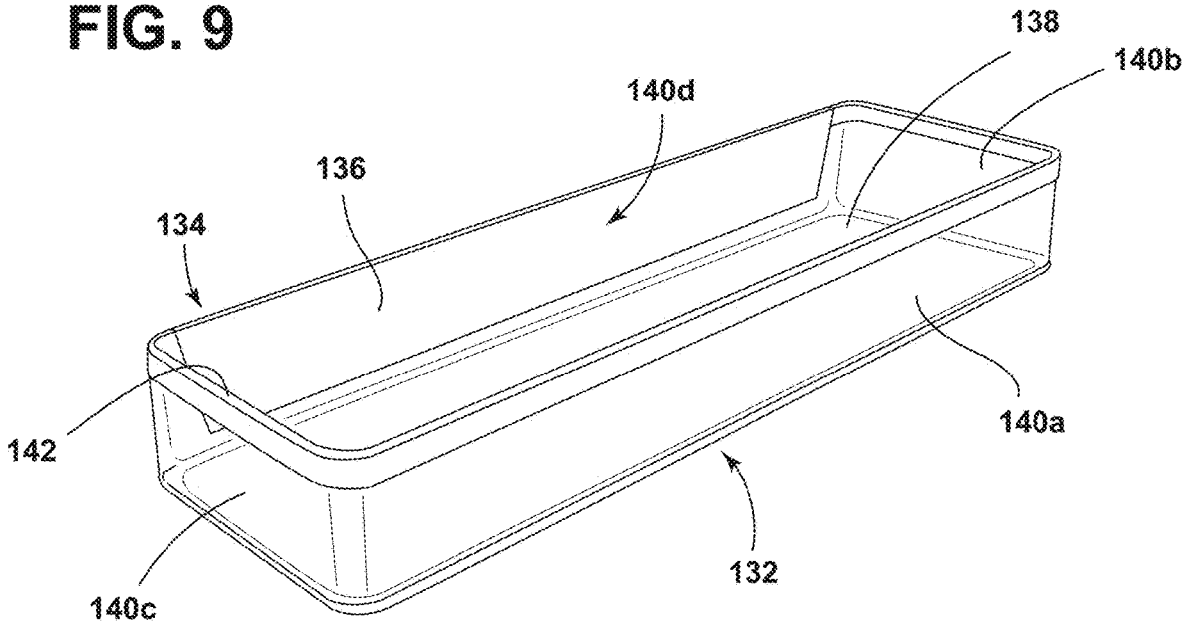
FIG. 10 is a perspective view of an example storage component useable with the magnetic arrangement of FIG. 9.

Turning to example shown in FIGS. 9 and 10 an alternative arrangement of the first and second magnetic components 130,136 can be used to retain storage components 132 with the attachment surface 128 of one or more doors 122 of a refrigerator otherwise generally similar to refrigerator 10 and the variations thereof discussed with respect to FIG. 2, above. Accordingly, various features of the example of FIGS. 9 and 10 are numbered similarly to what is shown in FIGS. 2-8, but increased by 100, including components not specifically discussed with respect to the present example, such components being understood as being generally similar to that which is discussed above. In particular, additional flexibility in the placement and mutual arrangement of multiple storage components 132 within and along the attachment surface 128. In particular, in the present example, the door 122 includes a single first magnetic component that extends along an entirety of the attachment surface 128 or at least a functional entirety of attachment surface 128 that extends along enough of the attachment surface 128 to allow for retention of the various storage elements 132 along the entire attachment surface 128. In such an arrangements, the storage components 132 are selectively removably retainable at the respective mounting surfaces 134 thereof at essentially any location along the attachment surface 128 by mutual attraction between the associated second magnetic component 136 and the first magnetic component 130.

In various implementations, the first magnetic component 130 can be a ferromagnetic material sheet, such as a sheet of steel or the like that can be adhered to the outer surface 144 of door liner 124. In such an arrangement the second magnetic component 136 can be one or more permanent electromagnets affixed with the outer wall 140*d* of the storage component 132. In the illustrated example, the second magnetic component 136 can be a permanently magnetic material sheet that can be glued, for example, to the mounting surface 134 or otherwise retained with the outer wall 140*d* of storage components 132 (such as being embedded therein or contained within a hollow interior space thereof. In another example, the second magnetic component 136 can be a plurality of magnets, such as various rare-earth magnets having a sufficient retention force, positioned at various locations along the mounting surface 134, for example at the corners thereof. In this manner, the storage component 132 can be retained with door 122 when the second magnetic component 136 is operably adjacent the ferromagnetic sheet comprising the first magnetic component 130. In an alternative arrangement the first magnetic component 130 can also be a permanently magnetic material sheet with the second magnetic component 136 being a permanently magnetic material sheet or a set of permanent electromagnets. In a further alternative arrangement, the first magnetic component 130 can be a permanently magnetic material sheet or distributed rare earth magnets on a ferromagnetic sheet, and the second magnetic component 136 can be a ferromagnetic material sheet, such as steel or the like.

In such an arrangement, either or both of the first and second magnetic components 130,136 can be selected to exhibit the desired properties, including the retention force or aggregate mutual retention force, to retain the various storage components 132 on door 122, including when loaded with an appropriate number of articles of a certain size or type. Further, such retention considerations can be balanced with the desire to have the storage components 132 be removable from door 122, when desired using an acceptable level of force. In one example, a retention force of between 15 N and 20 N may provide adequate retention of the storage components 132 with door 122, while making the storage components 132 removable, when desired. In further examples, the second magnetic component 136 can be moveably coupled with the storage component 132 such that a lever, knob, or the like can be incorporated with the storage components 132 to allow a user to move the second magnetic component 136 away from the associated first magnetic components 130, including with a provided mechanical advantage, to an amount to make the storage component 132 more easily removable from door 122. Further, the door liner 124, at least within attachment surface 128 can be of or coated with a high friction material or treatment to prevent the storage components 132 from slipping or otherwise inadvertently moved along the attachment surface 128 under normal use conditions.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only.

Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A refrigerator, comprising:

a housing defining an interior compartment with an open side;

a door rotatably coupled with the housing and selectively closing at least a portion of the open side, the door including a liner defining an outer attachment surface and an opposite inner surface, the attachment surface including a plurality of indicia of a plurality of predetermined attachment locations along the attachment surface, the door further including a plurality of first magnetic components adjacent an interior surface and aligned with respective ones of the indicia, the indicia being defined by raised attachment areas of the attachment surface of the liner, the liner further defining indented portions of the interior surface within the raised attachment areas of the attachment surface, the plurality of first magnetic components being coupled to the interior surface within the indented portions; and a storage component defining a mounting surface having an area smaller than the attachment surface, the storage component including a second magnetic component selectively releasably attachable to the liner at a selected one of the predetermined attachment locations by mutual attraction between the first magnetic component corresponding with the selected one of the predetermined attachment locations and the second magnetic component.

2. The refrigerator of claim 1, wherein the storage component is a first storage component of a plurality of storage components, each of the plurality of storage components including a respective second magnetic component and selectively releasably attachable to the liner at further selected ones of the predetermined attachment locations by mutual attraction between the first magnetic component corresponding with the respective selected ones of the predetermined attachment locations and the second magnetic components.

3. The refrigerator of claim 2, wherein:

the plurality of raised attachment areas are present along the liner in a first number; and the plurality of storage components are present in a second number that is less than the first number.

4. The refrigerator of claim 1, wherein the storage component is a storage bin including a lower surface, at least four side walls extending from the lower surface and defining an interior space and an open top side, the mounting surface being defined on one of the at least four side walls.

5. The refrigerator of claim 4 wherein:

the mounting surface of the storage bin defines a first profile; and a respective shape of the raised attachment areas generally corresponds with the first profile.

6. The refrigerator of claim 1, wherein the door further includes a plurality of sliders corresponding with respective ones of the first magnetic components and positioned along the liner adjacent the corresponding indicia.

7. A refrigerator door assembly, comprising:

a liner defining an outer attachment surface and an opposite inner surface, the attachment surface including a plurality of indicia of a plurality of predetermined attachment locations along the attachment surface, the door further including a plurality of first magnetic components adjacent an interior surface and aligned with respective ones of the indicia, the indicia being defined by raised attachment areas of the attachment surface of the liner, the liner further defining indented portions of the interior surface within the raised attachment areas of the attachment surface, the plurality of first magnetic components being coupled to the interior surface within the indented portions; and a storage component defining a mounting surface having an area smaller than the attachment surface, the storage component including a second magnetic component selectively releasably attachable to the liner at a selected one of the predetermined attachment locations by mutual attraction between the first magnetic component corresponding with the selected one of the predetermined attachment locations and the second magnetic component.

8. The refrigerator door assembly of claim 7, wherein the storage component is a first storage component of a plurality of storage components, each of the plurality of storage components including a respective second magnetic component and selectively releasably attachable to the liner at further selected ones of the predetermined attachment locations by mutual attraction between the first magnetic component corresponding with the respective selected ones of the predetermined attachment locations and the second magnetic components.

9. The refrigerator door assembly of claim 8, wherein:

the plurality of raised attachment areas are present along the liner in a first number; and the plurality of storage components are present in a second number that is less than the first number.

10. The refrigerator door assembly of claim 7, wherein the storage component is a storage bin including a lower surface, at least four side walls extending from the lower surface and defining an interior space and an open top side, the mounting surface being defined on one of the at least four side walls.

11. The refrigerator door assembly of claim 10, wherein:

the mounting surface of the storage bin defines a first profile; and a respective shape of the raised attachment areas generally corresponds with the first profile.

12. The refrigerator door assembly of claim 7, wherein the door further includes a plurality of sliders corresponding with respective ones of the first magnetic components and positioned along the liner adjacent the corresponding indicia.

13. The refrigerator door assembly of claim 12, wherein:

the at least one of the plurality of first magnetic components is a permanent electromagnet exhibiting a magnetic field having a maximum strength in an absence of an electrical current and a diminished strength in a presence of the electrical current; and a release lever is associated with electronic circuitry selectively subjecting the permanent electromagnet to a current of a variable current associated with the position of a respective slider.

14. A refrigerator, comprising:

a housing defining an interior compartment with an open side;

a door rotatably coupled with the housing and selectively closing at least a portion of the open side, the door including a liner defining an outer attachment surface and an opposite inner surface, the attachment surface including a plurality of raised attachment areas corresponding with a plurality of predetermined attachment locations along the attachment surface, the door further including a plurality of first magnetic components adjacent an interior surface and aligned with respective ones of the raised areas, indicia corresponding with the raised attachment areas of the attachment surface of the liner, the liner further defining indented portions of the interior surface within the raised attachment areas of the attachment surface, the plurality of first magnetic components being coupled to the interior surface within the indented portions; and a storage component defining a mounting surface having an area smaller than the attachment surface, the storage component including a second magnetic component selectively releasably attachable to the liner at a selected one of the predetermined attachment locations by mutual attraction between the first magnetic component corresponding with the selected one of the predetermined attachment locations and the second magnetic component.

15. The refrigerator of claim 14, wherein:

the mounting surface of the storage bin defines a first profile; and the raised attachment areas defines an edge generally corresponding in shape with the first profile.

* * * * *